United States Patent [19]

Schibbye

[11] 3,945,216

[45] Mar. 23, 1976

[54] REFRIGERATION SYSTEMS

[75] Inventor: Hjalmar Schibbye, Saltsjo-Boo, Sweden

[73] Assignee: Svenska Rotor Maskiner Aktiebolag, Nacka, Sweden

[22] Filed: Dec. 16, 1974

[21] Appl. No.: 533,161

Related U.S. Application Data

[63] Continuation-in-part of Ser. No. 480,400, June 18, 1974, abandoned.

[30] Foreign Application Priority Data

June 18, 1973 United Kingdom ..... 28742/73

[52] U.S. Cl. ..... 62/84; 418/201; 62/115; 62/470; 62/473; 62/498

[51] Int. Cl.[2] ..... F25B 43/02

[58] Field of Search ..... 418/201; 62/115, 470, 473, 62/84, 498

[56] References Cited

UNITED STATES PATENTS

| | | | |
|---|---|---|---|
| 3,138,320 | 6/1964 | Schibbye | 418/99 |
| 3,408,828 | 11/1968 | Soumerai | 62/470 |
| 3,432,089 | 3/1969 | Schibbye | 418/201 |
| 3,558,248 | 1/1971 | Parker | 418/201 |
| 3,710,590 | 1/1973 | Kocher | 62/470 |
| 3,736,079 | 5/1973 | Kantz | 418/99 |
| 3,811,291 | 5/1974 | Schibbye | 62/473 |

*Primary Examiner*—William J. Wye
*Attorney, Agent, or Firm*—Flynn & Frishauf

[57] ABSTRACT

Vehicle air-conditioning and other refrigerator systems utilizing specified helical screw compressors and operated under specified conditions and using specified refrigerants and oils. Also disclosed are improved hydrocarbon compressor systems which also utilize specified helical screw compressors and are operated under specified conditions using specified oils selected in relation to the hydrocarbon being compressed.

44 Claims, 13 Drawing Figures

Fig. 1a
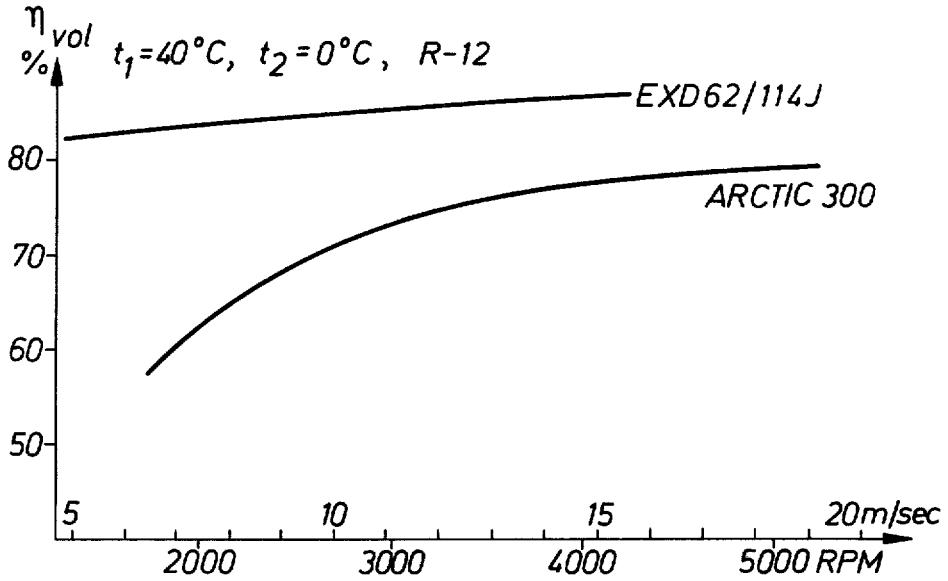
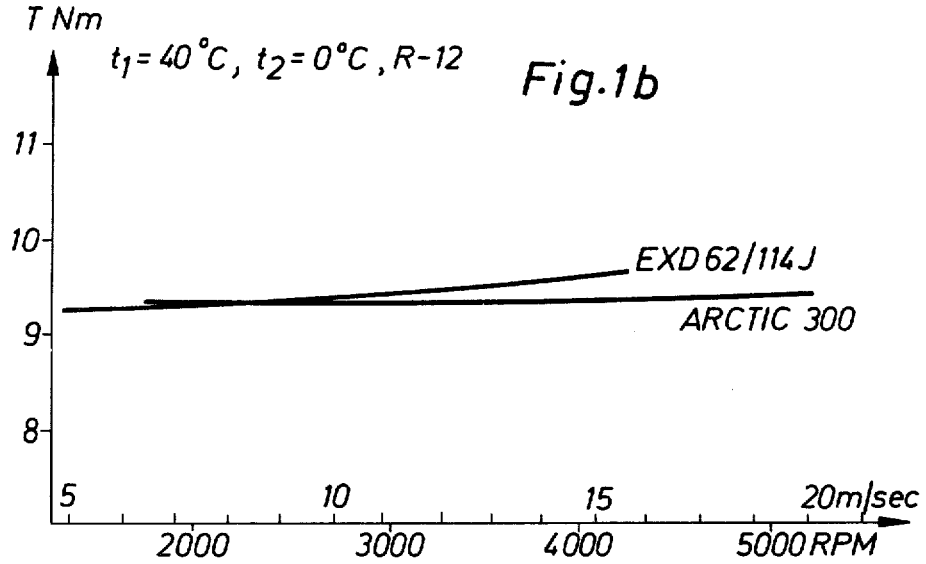
Fig. 1b $\eta_{ad\ tot}$ %
$t_1$=70°C, $t_2$=0°C, R-12
80
60
40
20
EXD 62/114J
EXD 62/127K
ARCTIC 300
5
10
15
20 m/sec
2000
3000
4000
5000 RPM COP
$t_1$=70°C, $t_2$=0°C, R-12
4
3
2
1
EXD62/127K
EXD62/114J
ARCTIC 300
5
10
15
20m/sec
2000
3000
4000
5000RPM

REFRIGERATION SYSTEMS

This application is a continuation-in-part of application Ser. No. 480,400 filed June 18, 1974 and now abandoned.

This invention relates to helical screw type compressors including a working gaseous medium of the hydrocarbon or halocarbon compound type, and a lubricating oil medium circulating through the compressor for apositively sealing clearances present in the compressor under working conditions.

The invention is particularly, but not exclusively concerned with a method for improving the low tip speed characteristics of compressors of the above-mentioned type.

Moreover, the invention is particularly, but not exclusively, concerned with refrigeration and air conditioning systems and methods employing a refrigerant, for example the medium pressure refrigerant widely known as R12, or the high pressure refrigerant widely known as R22, and including a helical screw compressor having oil injection facilities, an oil separator, a condenser, an expansion valve and an evaporator. The invention is also concerned with apparatus and methods for use in industrial processes requiring compression of hydrocarbon or halocarbon gases, such as compression of hydrocarbon gases which are then condensed to form liquified gas and the storage of liquid propane gas and pipeline transport of natural gas.

Air conditioning apparatus including screw compressors have been widely used in relatively large refrigeration and air-conditioning plants. However, up to now it has not been feasible to use screw compressors in air-conditioning plants having a refrigeration capacity of less than 300,000 kcal/hour and, in certain instances for refrigeration plants less than 100,000 kcal/hour.

This lower limit of refrigeration capacity depends upon the specific characteristics of the screw compressor. It is well known that a screw compressor is a positive displacement type of compressor in which a certain internal leakage always takes place through clearances existing between the rotors and surrounding casing walls. The sealing is referred to as apositive sealing. The amount of leakage is a function of, among others, the size of the clearances, the output pressure, and the peripheral rotor (tip) speed. The rotors must be run at a high peripheral speed in order to reduce the internal leakage and achieve a sufficiently high volumetric efficiency which is necessary for obtaining an acceptable overall efficiency. In dry running compressors acting upon air or other gases as the working fluid it has been found that the tip speed of the male rotor should not fall below about 80 m/s. In compressors acting on air or other gases and fitted with means for injecting oil during compression, and utilizing such means, the cooling of the rotors and the housing is improved and smaller clearances can therefore be accepted between the relatively movable members. Additionally, the oil acts partially to "seal" such clearances and reduce such internal leakage. In such so-called wet compressors the tip speed of the male rotor can then be reduced to about 25–30 m/s with retained satisfactory overall efficiency. Owing to the fact that refrigeration compressors are usually directly driven by electric motors, the maximum speed of which is normally about 2900 rpm or 3600 rpm depending on the frequency of the current, the diameter of such compressors is normally no less than 160 mm, which compressor size corresponds to the minimum refrigeration capacity 100,000–300,000 kcal/hour mentioned above.

One particular application of an air conditioning apparatus in which it has hitherto not been suitable to use a screw compressor is in automotive air conditioning plants, where the required refrigeration capacity is in the region of 3,000 kcal/hour. A solution of the performance problems at low tip speeds, that could make it possible to use the screw compressor for this purpose, would be highly desirable, owing to the small bulk, the low weight and the vibration free operation of the screw compressor compared with conventional reciprocating piston compressors now used for such purposes. The underlying reasons for the unsuitability of the screw compressor in automotive air conditioning installations are, on one hand, that the refrigeration capacity required is so small and amounts only to about 3–1% of the normal minimum capacity, referred to previously, and, on the other hand, that the compressor in such a plant is normally driven from the engine of the car via a belt transmission, which means a very low compressor speed at motor idling.

The capacity of the compressor will of course increase with the operating speed. However, the capacity needed for cooling the air in a car has to be available even at low engine speed. This means that the compressor will give more refrigeration capacity than needed at higher engine speeds. This is a problem which is common for all types of compressors, but use of the screw compressor offers a very attractive way of capacity regulation in that a slide valve or other efficient means for capacity control may be used, which is an additional reason for the suitability of the screw compressor for use in automotive air conditioning systems.

Assuming a step up gear ratio between the compressor input speed and the engine speed of 2:1, the compressor input speed at 1400 rpm engine speed will be 2800 rpm. If the refrigerant R12 is used and if the refrigeration capacity demand at this speed is 3,000 kcal/hour at 70°C condensing temperature and 0°C evaporating temperature the requisite compressor displacement volume to obtain this refrigeration capacity is about 11 $m^3/h$, which corresponds to a rotor diameter of about 45 mm, giving a tip speed at 2800 rpm of about 10 m/s. ($L/D = 1.0$)

However, in an automotive air conditioning apparatus the compressor has to operate at engine speeds from 700 rpm to 7000 rpm. This means a compressor input speed of 1400 to 14000 rpm, corresponding to a male rotor tip speed of 5.0 m/s to 50 m/s. The corresponding tip speeds for the female rotor are 3.3 to 33 m/s. In this example we have assumed a "4 + 6 lobe combination" and "female rotor drive". This means that the male rotor has four lands and the female rotor six grooves and that the compressor is driven on the female rotor. The speed ratio between the male rotor speed and the female rotor speed is consequently 1.5:1.

On cars fitted with automatic transmission the engine speed seldom exceeds 3000 rpm, corresponding to a male rotor tip speed of 21 m/s. This means that the compressor will operate at tip speeds below 20 m/s 95% of the time.

In a typical screw compressor having a rotor diameter of 200 mm, the mean clearances in the rotor mesh and at the rotor tops and at the rotor ends is generally approximately 0.15 mm. When the rotor diameter is decreased to 50 mm, the mean clearances generally would be designed to be about 0.05 mm to provide for economic manufacturing and operating tolerances. Unfortunately, the efficiency characteristics of 50 mm rotor machines when tested with the conventional combination of halocarbon refrigerant gases and oils were not acceptable. Similar poor efficiency characteristics were found with even the larger rotor machines when attempts were made to compress hydrocarbon gases using conventional oils. Various suggestions to improve efficiency have been made, including designing smaller clearances, e.g., a mean clearance of 0.05 mm for a 200 mm rotor machine, and of 0.01 mm for a 50 mm rotor machine. Such small clearances require tight manufacturing tolerances which excessively increase manufacturing cost. They also introduce operating difficulties. In order to use the screw compressor for small capacities it has also been suggested to use internal step up gears in combination with small size rotors with or without such smaller clearances.

Such suggested measures to improve efficiency are not practically suitable. As a consequence, it has not been possible to provide a helical screw compressor which would provide the desired output capacities at the range of tip speeds found in automotive air-conditioning applications, and which would also have the small capacity level required in automotive applications without requiring excessively tight clearance tolerances in the machine. Similar difficulties were found with small rotor diameter compressors for other air conditioning and refrigeration purposes such as room air conditioners.

It is an object of the present invention to provide helical screw compressors and methods of operation thereof with halocarbon or hydrocarbon gaseous working mediums which are more efficient than those of the prior art. It is also an object of the present invention to provide improved compressor systems and methods, including refrigeration (which term includes air-conditioning) systems and methods.

SUMMARY OF THE INVENTION

The present invention provides efficient small and large refrigeration systems utilizing halocarbon refrigerants and screw compressor oils having specified solubility and viscosity relationships to the refrigerant and compressor characteristics. The invention also provides improved hydrocarbon compressor systems based on similar relationships. It has been unexpectedly found that by circulating oil of a special quality in the compressor, which oil has limited solubility in and for halocarbon refrigerants, and for hydrocarbons and which generally has a considerably higher viscosity compared to other oils used for such purposes, the volumetric efficiency of the compressor and thereby the capacity of the compressor shows a decided improvement. At the same time the compressor input torque and thereby the compressor input power remains equal or even decreases which is quite opposite from what one would expect when a more viscous oil is used. This means that the overall efficiency of the compressor will increase to a level which is acceptable for use in automotive air-conditioning plants and advantageous for use in other refrigeration plants and in hydrocarbon compression plants. After further investigation of this amazing effect, general and optimal relations have been found between the oil quality, the oil viscosity, the gaseous media on which the compressor is working, the compressor (male rotor) tip speed and the actual working conditions. By using these relations for compressor plants, operating on hydrocarbon or halocarbon compounds, it is possible to use the screw compressor for capacities down to about 1,000 kcal/hour and/or 4 $m^3/h$ and to improve the overall efficiency of oil injected screw compressors operating on halocarbon or hydrocarbon compounds to a superior efficiency level.

According to the invention, this improved efficiency is obtained in the system by the oil and the working gaseous medium satisfying various interrelationships such that said oil with said gaseous medium dissolved in said oil has a viscosity which is sufficiently high to maintain a high overall efficiency of said compressor. Thus, the invention eliminates the use of very small clearances, very small rotor diameters in combination with internal step up gears and other undesirable measures, previously suggested in order to improve the overall efficiency of helical screw compressors. Normal clearances can be used in the compressors according to the present invention.

BRIEF DESCRIPTION OF THE DRAWINGS

FIGS. 1*a*–1*d* are curves illustrating the compressor characteristics using three oils with the refrigerant R12;

DETAILED DESCRIPTION

Figure 4A:
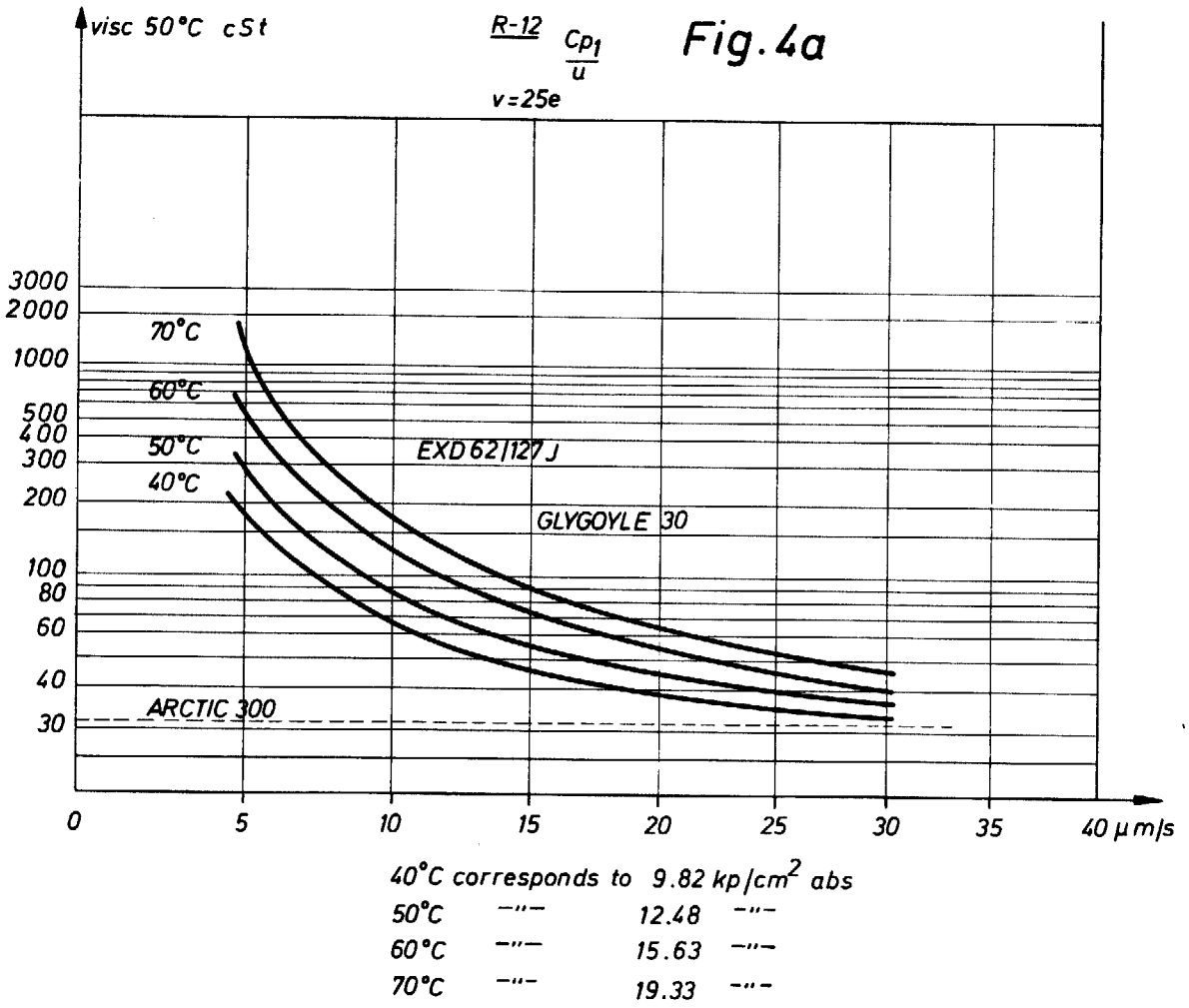
FIGS. 4*a* and 4*b* illustrate the minimum oil viscosity requirements for a compressor working under various operating conditions, FIG. 4*a* referring to the use of the compressor with the refrigerant R12 and FIG. 4*b* referring to the use of the compressor with the refrigerant R22.
Figure 4B:
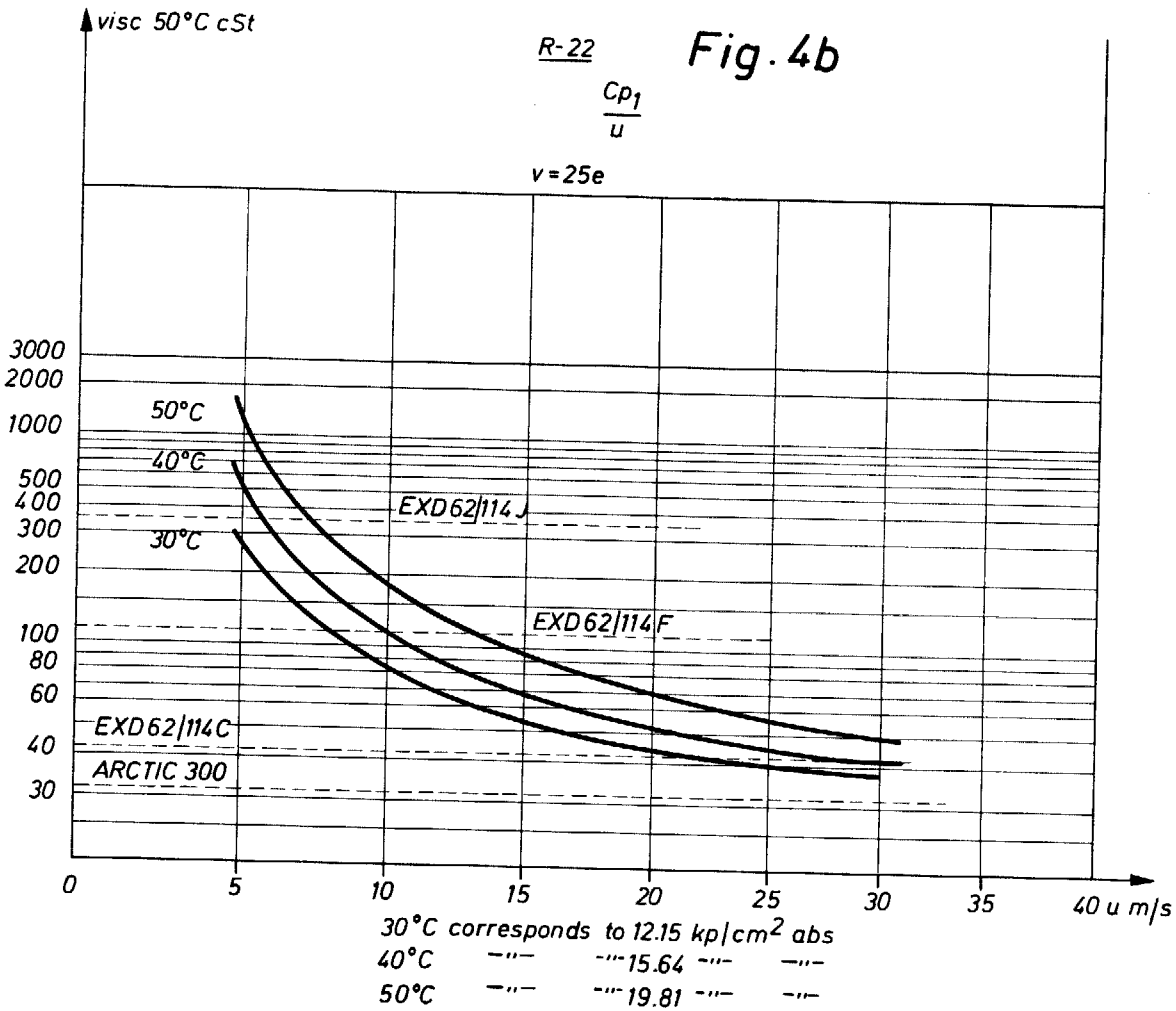
Figure 5:
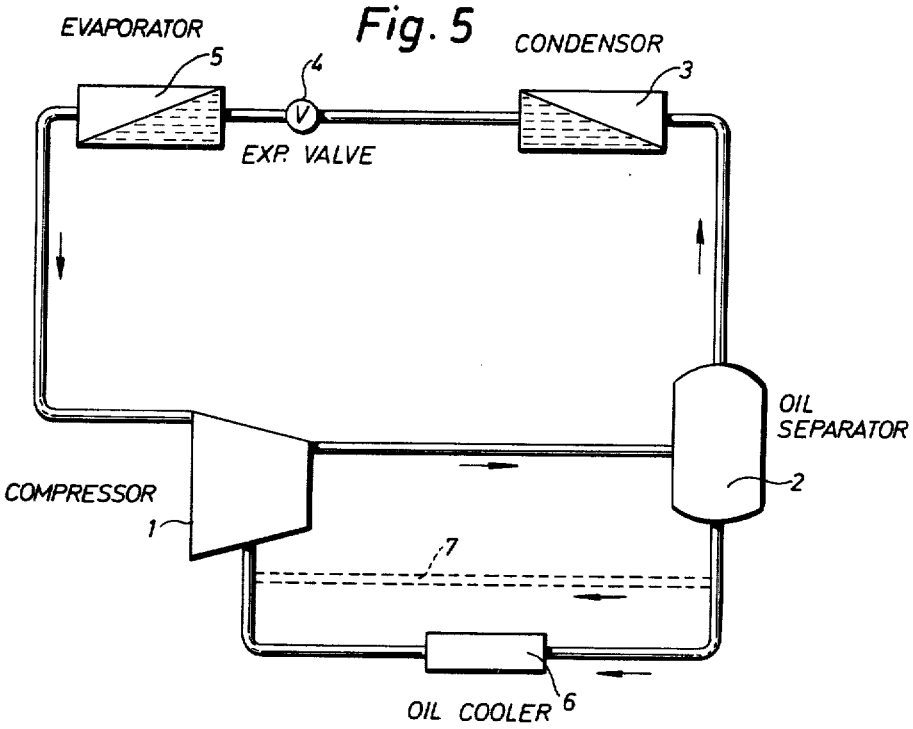
FIG. 5 is a schematic diagram of a typical refrigeration system operating in accordance with the present invention.
Figure 6:
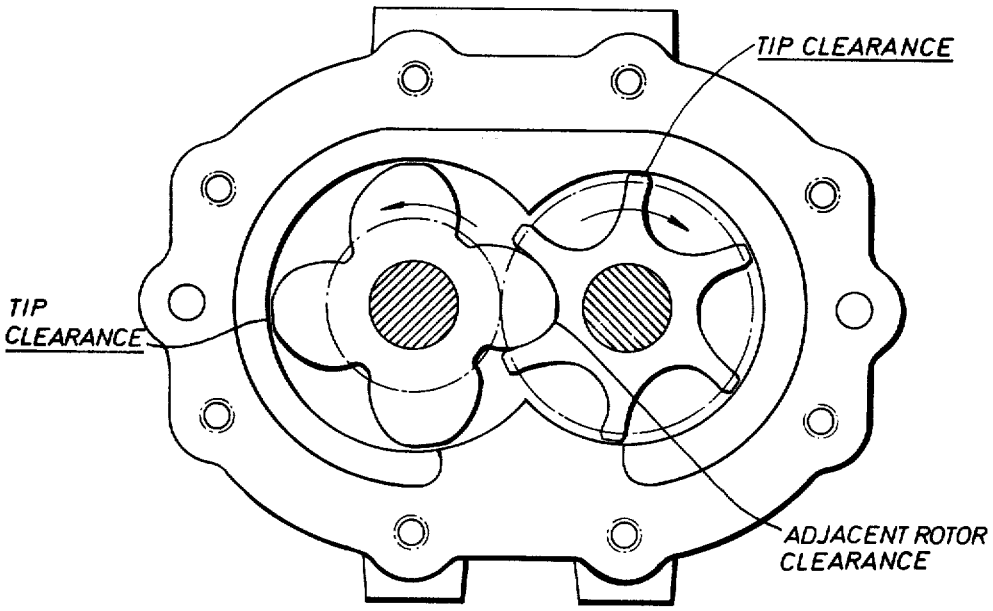
FIG. 6 is a sectional view of a typical compressor.

FIG. 5 generally illustrates a refrigeration system in which the present invention is useful. The compressor 1 illustrated in FIG. 5 is a helical screw rotary compressor of the type generally disclosed in U.S. Pat. Nos. 3,129,877; 3,241,744; 3,307,777; 3,314,597; 3,423,017; 3,423,089; and 3,462,072, an end view of a typical rotary compressor being shown in FIG. 6 in order to illustrate the various clearances involved. The refrigeration system includes the compressor 1, an oil separator 2, a condenser 3, an expansion valve 4, an evaporator 5, and an oil cooler 6 interconnected as generally illustrated in FIG. 5. The oil may be injected through the slide valve as disclosed in U.S. Pat. No. 3,314,597 (FIGS. 1 and 4) and/or through the casing, e.g. as disclosed in U.S. Pat. No. 3,129,877 (FIG. 1) and U.S. Pat. No. 3,241,744 (FIG. 9) which are incorporated herein by this reference. As is generally known in the art, the discharge temperature of the compressor is a function of the discharge pressure of the working fluid and the pressure ratio. Therefore, by specifying the discharge pressure of the compressor, given the characteristics of the compressor and the system, the output temperature of the system can be readily determined by one ordinarily skilled in the art.

The following discussion of the present inventive concept is given with respect to, but is not limited to, a machine using "normal clearances" as discussed hereinabove. Of course, if the rotor diameter is other than 50 mm or 200 mm, the normal mean clearance will vary accordingly, as is readily apparent to those ordinarily skilled in the art in fabricating compressors operating according to known techniques.

The suitability of a particular oil under specified compressor operating conditions is dependent upon its viscosity and the relationship between the relative capacitivity of (i) the oil, and (ii) the liquified gaseous medium (which is a halocarbon or hydrocarbon gas) being compressed. The relationship (1) below governs the solubility of the gas (halocarbon or hydrocarbon) in the oil. This strongly effects the working viscosity of the oil in the screw compressor.

It is preferred that the relationship between the relative capacitivity of the oil, $\epsilon_{r_{oil}}$, and that of the liquified gaseous medium, $\epsilon_{r_{gas}}$ both measured at 50°C, is as follows:

$$\left| \ln \epsilon_{r_{oil}} - \ln \epsilon_{r_{gas}} \right| = x \geqq 1 \qquad (1)$$

where $\ln$ is the natural logarithm. The "relative capacitivity" of a material is the preferred term for the property often referred to as the dielectric constant. This property of a material, as specified in data collections, is the ratio of the capacitance of a condenser with said material as the dielectric to its capacitance with vacuum as the dielectric. The specified (or experimentally determined) "dielectric constant" values are the relative capacitivity values $\epsilon_r$ for the liquified gas and oil, respectively. Although it is preferred that $x$ should be greater than or equal to 1, values of $x$ of less than 1 may be useful as specified hereinafter. The value $x$ is an absolute value and therefore it is immaterial whether it is positive or negative.

When $x$ is equal to or greater than 1, the kinematic viscosity, $v$, of the pure oil measured in centistokes (cSt) at 50°C must not drop below the value obtained from the formula $$v = 25 \cdot e^{[(c \cdot p_1)/u]} \qquad (2)$$

where $p_1$ is the discharge pressure of the compressor, $u$ is the tip speed of the male rotor, $e$ is the base of the natural system of logarithms and $c$ is a constant equal to $$1 \frac{cm^2 \cdot m}{kp \cdot sec}$$

if $p_1$ is measured in kp/cm² and $u$ is measured in m/sec. The kinematic viscosity $v$ of the "pure oil" refers to the viscosity of the oil without any dissolved refrigerant or hydrocarbon gaseous medium i.e., the oil as received in the can. The kinematic viscosity is determined by ASTM D-445-65 and DIN 51 562.

The tip speed u is preferably a maximum of about 40 m/sec in oil-injected refrigeration screw compressors. The minimum pressure $p_1$ is above about 10 kp/cm² when operating with a halocarbon gaseous medium (a refrigerant) and above about 8 kp/cm² when operating with a hydrocarbon gaseous medium. The maximum pressure is preferably about 30 kp/cm².

The present invention provides small refrigeration systems and apparatus having a screw compressor with male rotor diameters of below about 105 mm with a lower limit of about 30 mm and preferably about 40 to 105 mm which operate at male rotor tip speeds of between about 5 and 30 m/sec. The value of the kinematic viscosity $v$ is preferably within the range determined by the formula $$v = Y \cdot e^{[(c \cdot p_1)/u]} \qquad (3)$$

where $Y$ is between 25 and 200 (and preferably about 50 to 100) when $x$ is equal to or greater than 1. When $x$ is less than 1 the minimum kinematic viscosity is determined by the formula $$v = \frac{Y}{\sqrt{x}} e^{[(c \cdot p_1)/u]} \qquad (4)$$

The preferred value of Y in said formula is between 50 and 100. These ranges will be suitably modified by the term $\sqrt{x}$ when $x$ is less than 1 as per the above formula (4).

The small refrigeration systems (as illustrated in Examples 1 and 5) utilizing the halocarbon refrigerant gases include the automobile air conditioners in which the compressor is driven at variable speed. These would have small rotor diameters, e.g., between about 40 and 55 mm and be driven at a speed of between about 1,200 and 14,000 rpm (below about 5,000 rpm 95% of the time. Other small refrigeration systems, e.g. small refrigerators and residential, office and warehouse air-conditioners (as illustrated in Examples 2 and 6) utilizing the halocarbon refrigerant gases are usually driven by two-pole electric motors at about 2,900 and 3,500 rpm.

The present invention also provides large refrigerator systems and apparatus (as illustrated in Examples 3 and 7) having compressor male rotor diameters of between about 105 and 300 mm which operate at male rotor tip speeds of between about 15 and 50 m/sec and preferably between about 25 and 40 m/sec, and utilize the halocarbon refrigerant gases. The minimum and preferred viscosities $v$ are determined as in formulas 1, 3 and 4 except that Y is between about 30 and 200 and preferably between about 40 and 100. Such compressors will usually be driven by two-pole motors at between about 2,900 and 3,500 rpm.

The improved hydrocarbon compressor systems and apparatus of the present invention (as illustrated in Example 4) have compressor male rotor diameters of between about 150 and 350 mm which operate at male rotor tip speeds of between about 22 and 65 m/sec and preferably between about 25 and 40 m/sec. The minimum and preferred viscosities are those determined in formulas 1 and 3. The Y values are between 25 and 200 with 50–100 being preferred. The value of $x$ must be equal or greater than 1. They are also usually driven by two-pole motors at between about 2,900 and 3,500 rpm.

The small and large refrigeration systems and the hydrocarbon compression systems and the improved refrigeration systems of the present invention may be equal to or more efficient than the most efficient of comparable sized systems having similar system characteristics utilizing the most efficient of presently available compressors. In some cases, however, the efficiency may drop to a value between about 90% and 100% of said efficiency. In other cases, the systems of the present invention, and particularly the refrigeration systems, may be simpler (more economic) and/or more efficient than known systems.

Automobile air-conditioners have a refrigeration capacity demand of about 1,000–5,000 kcal/h. The male rotor diameter is between 40 and 55 mm. Operation is between 1,200 and 14,000 rpm. The preferred refrigerant is R12. The condenser is cooled by ambient air. The evaporator temperature is preferably between about −5°C and 10°C, and operates at a pressure above 1 atmosphere. The preferred oil has an $\epsilon$ value of between 4.9 and 8 and a $v$ value of between 270 and 660. The preferred oils are polyglycol oils.

Small stationary compressors used in residences, offices and small warehouses have a capacity of about 2.5 to 50 tons of refrigeration and generally use R22 as the refrigerant and use an oil having an $\epsilon$ value between 1.3 and 2.2 (and most preferably about 2.1) and a $v$ value of between about 80 and 550. The synthetic hydrocarbon oils are preferred.

It is further preferable that the viscosity index of the oil (according to ASTM D 2270) is at least 90 so that effective sealing is maintained at working temperatures up to at least 150°C.

With apositive sealing, in contrast with positive sealing such as that effected by the piston rings of positively sealed reciprocating piston compressors, volumetric efficiency of the machine is dependent upon the extent of the pressure rise in the compression chambers during any one cycle, or in other words, the value of the compression ratio, since the leakage from the apositively sealed compression chambers will obviously increase with increase in the pressure rise in a single stage.

Representative halocarbons (which are the fluorine substituted hydrocarbons with or without additional chlorine or bromine substitution) and hydrocarbons include:

| Designation | Compound | $\epsilon_{r(liq)}$ (at 50°C) |
|---|---|---|
| R11 | $CCl_3F$ | 1.9 |
| R12 | $CCl_2F_2$ | 1.8 |
| R13 | $CClF_3$ | 1.8 |
| R13B1 | $CBrF_3$ | 2.3 |
| R21 | $CHCl_2F$ | 4.9 |
| R22 | $CHClF_2$ | 6.0 |
| R290 | propane | 1.3 |
| | n-heptane | 1.6 |
| | n-hexane | 1.5 |
| | octane | 1.6 |

The $\epsilon_r$ at 50°C for R12, R22 and propane were determined (measured) by the Royal Institute of Technology, Stockholm. The other $r$ values at 50°C were determined by extrapolation from published data, largely in Lange's *Handbook of Chemistry*.

The substituted methane halohydrocarbons and particularly R12 and R22 are the most widely used and preferred refrigerant gases. The hydrocarbons are sometimes used as refrigerant gases, usually when they are readily and cheaply available, e.g., in oil refineries and chemical plants. High pressure compressors used for compressing hydrocarbon gases (including those specified as refrigerants hereinbefore) for purposes other than cooling, e.g., compressing in industrial processing storage, and transport (including long distance pipelines) and compressing hydrocarbons in gas liquifaction and vapour recovery plants, also require an oil having the relationships between the oil and refrigerant specified in formulas (1) and (3). Such hydrocarbon gases include among other commercial gases, natural gas, propane and the saturated and unsaturated $C_4$ and $C_5$ hydrocarbons.

The kinematic viscosities $v$ which satisfy the equations (2), (3) and (4) are generally high. The oils specified hereinafter are suitable for use in the systems of this invention when the values of $p_1$, $u$, $x$ and Y satisfy the said equations. The effect of certain of these variables is illustrated in FIGS. 4*a* and 4*b*.

| Polyglycol Oils | viscosity index | v(50°C) cSt | $\epsilon_r$ (50°C) |
|---|---|---|---|
| Glygoyle 22 * | 164 | 100 | 4.85 |
| Glygoyle 30 * | 165 | 148 | 5.0 |
| EXD 62/127J | 241 | 278 | 5.7 |
| EXD 62/127K | | 660 | 6.0 |
| Synthetic Hydrocarbon Oils (SHC) * | | | |
| EXD 62/114K | 160 | 550 | 2.1 |
| " J | 154 | 360 | 2.1 |
| " F | 148 | 114 | 2.1 |
| " E | 147 | 80 | 2.1 |
| " C | 148 | 41 | 2.1 |

* Trademarked products of the Mobil Oil Corporation.

According to the invention an oil of the synthetic hydrocarbon type is preferably used in combination with refrigerant R22 and an oil of the synthetic polyglycol type is preferably used in combination with refrigerant R12 or hydrocarbon gases.

Figure 1C:
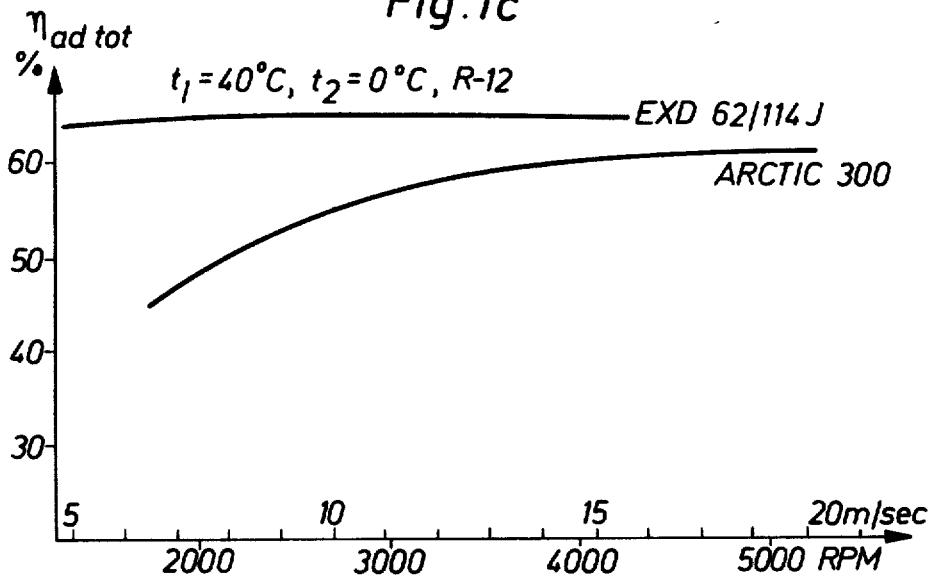
Figure 1D:
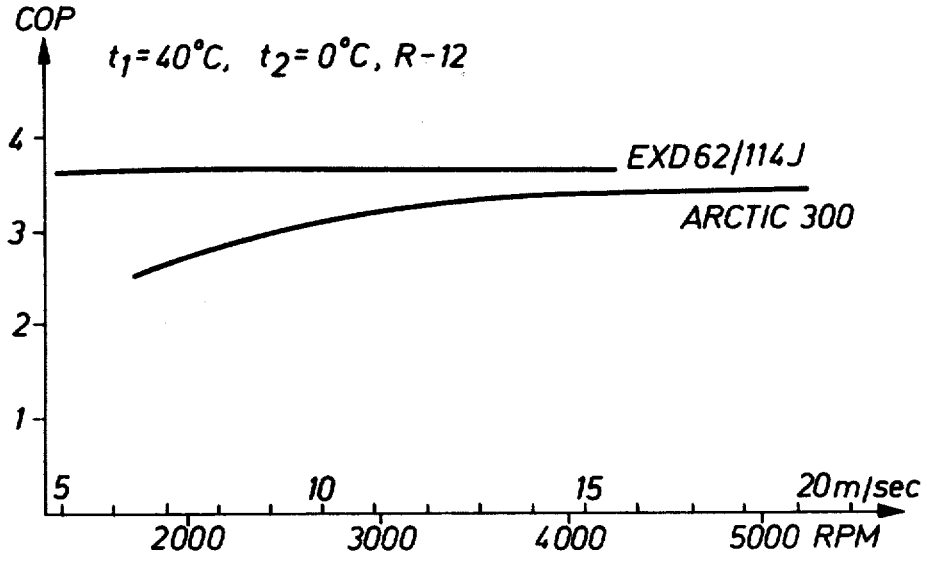

An example of a synthetic hydrocarbon oil are the Mobil SHC oils and the improved efficiency obtained by using one type of this oil in combination with refrigerant R12 is shown in FIG. 1 (condensation temperature 40°C, oil quality EXD 62/114J) as compared with a naphthenic mineral oil, Mobil Gargoyle Arctic 300.

The synthetic polyglycol oils are exemplified by the Mobil Glygoyle oils. The improved efficiency obtained by using one type of this oil in combination with refrigerant R12 is shown in FIG. 2 (condensing temperature 70°C, oil quality EXD 62/114J and EXD 62/127K) as compared with a naphthenic mineral oil, Mobil Gargoyle Arctic 300.

Figure 2A:
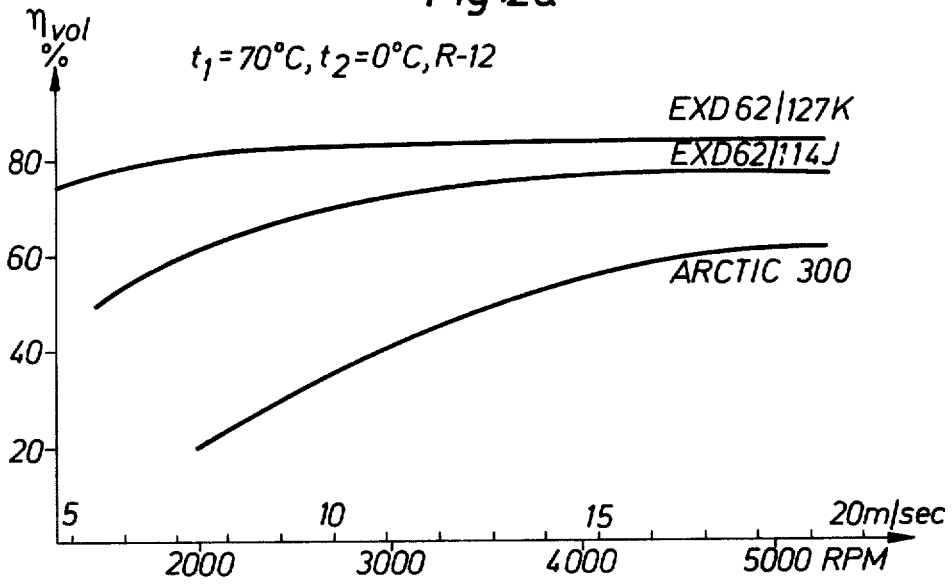
FIGS. 2*a*–2*d* are curves illustrating the compressor characteristics using three oils with the refrigerant R12 under conditions different from those of FIGS. 1*a*–1*d;*
Figure 2B:
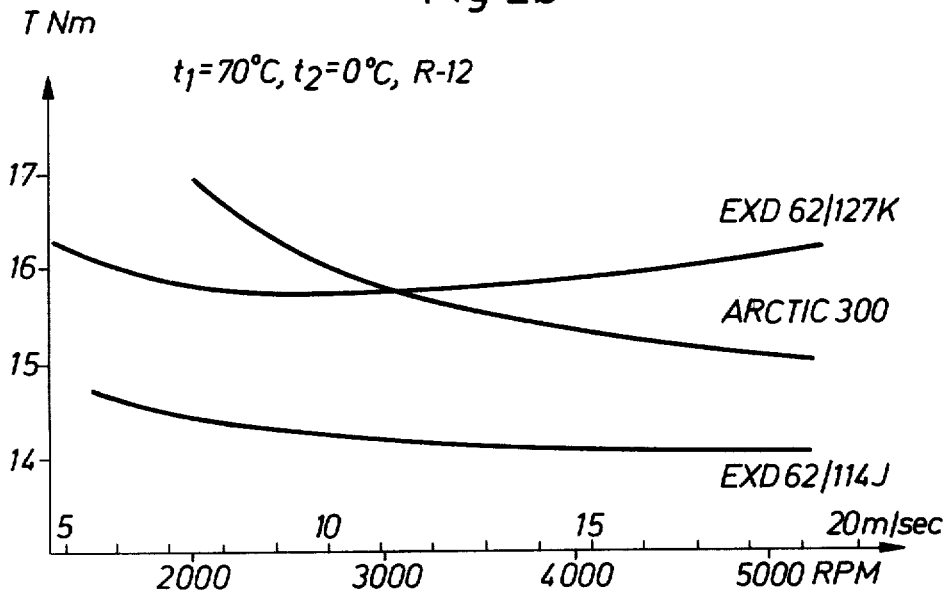
Figure 2C:
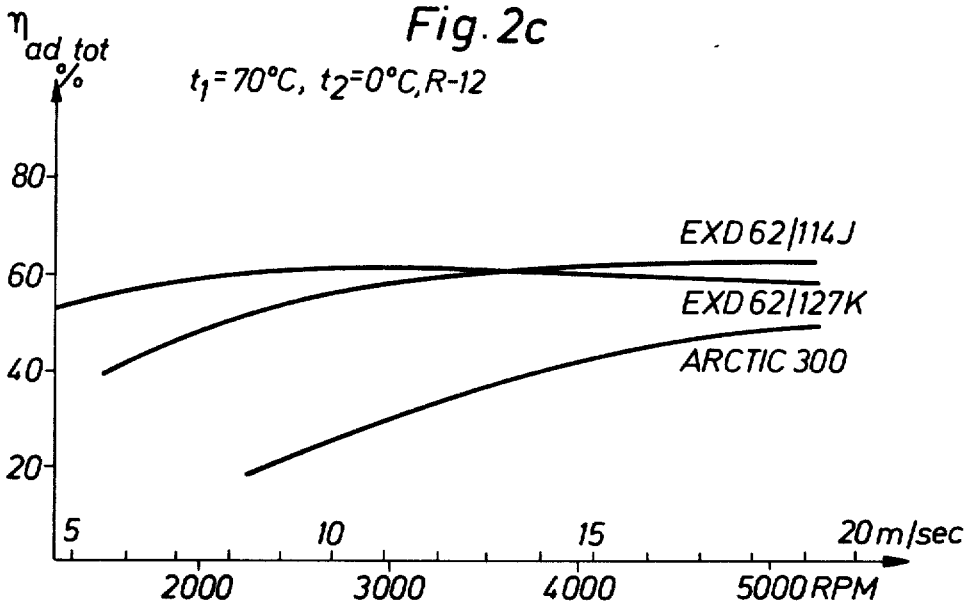
Figure 2D:
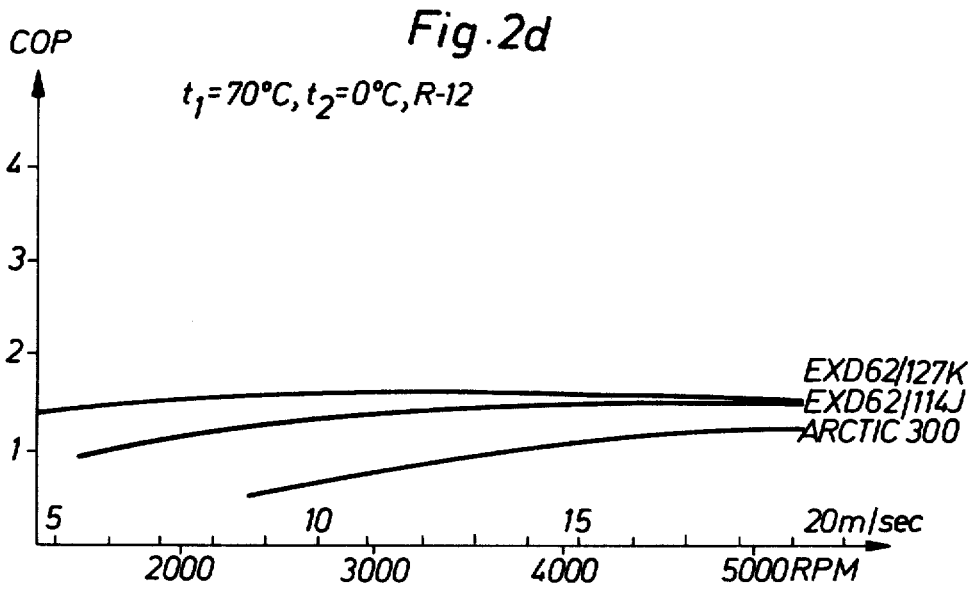

The use of SHC and Glygoyle oils has a marked effect on the volumetric efficiency ($\eta_{vol}$), the total adiabatic efficiency ($\eta_{ad_{tot}}$) and the coefficient of performance (COP) as shown in FIGS. 1*a*, 2*a*; 1*c*, 2*c* and 1*d*, 2*d* respectively. The input torque (T) is substantially equal to, as shown in FIG. 1*b*, or lower than, as shown in FIG. 2*b*, the torque obtained with a standard refrigeration oil of the naphthenic base type such as Mobil Gargoyle Arctic 300.

Figure 3:
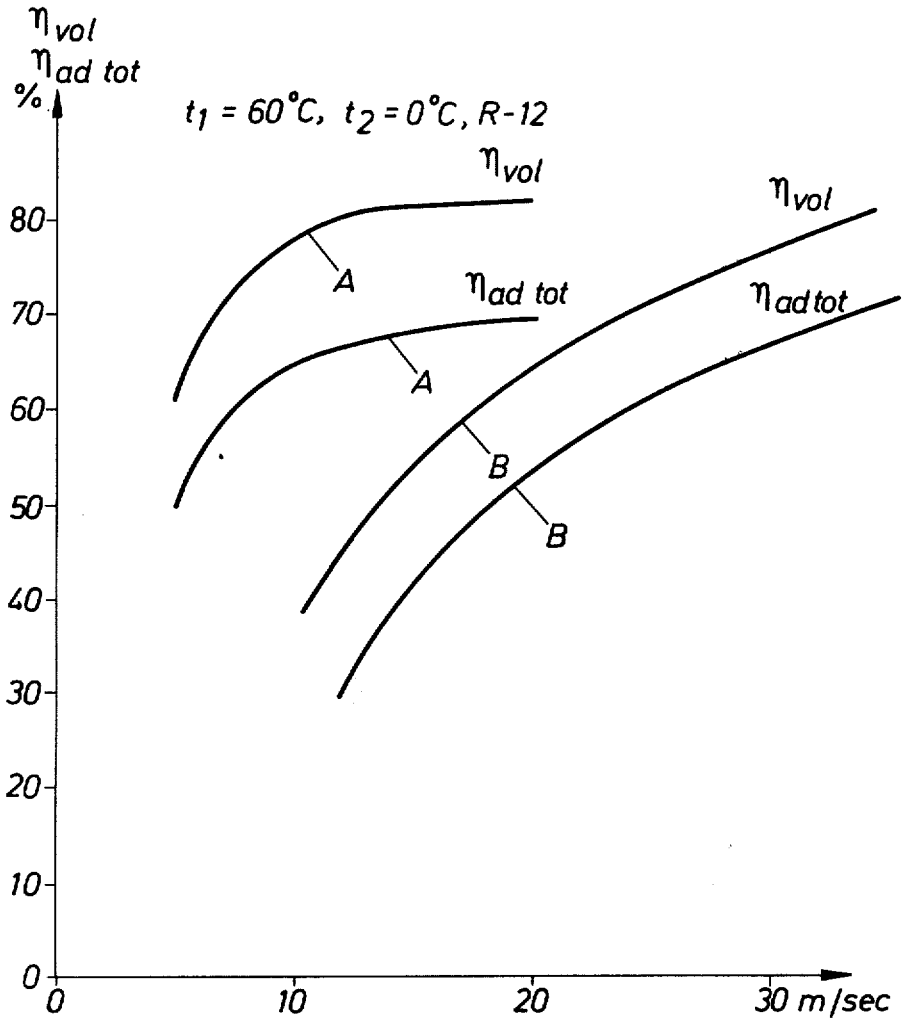
FIG. 3 are curves illustrating the efficiency versus tip speed for two compressors using different oils under specified working conditions.

The improved volumetric ($\eta_{vol}$) and adiabatic ($\eta_{ad_{tot}}$) efficiencies are also shown in FIG. 3 for two compressors, operating at 60°C condensing temperature, namely compressor A (rotor diameter = 47 mm, rotor length (L)/diameter (D) ratio = 1.7:1, Vs = 0.0825 1/rev), using a polyglycol oil (EXD 62/127J) and compressor B (rotor diameter = 102 mm. L/D radio = 1:1Vs = 0.516 1/rev), using a standard mineral oil (Arctic 300). It is believed that injection of the polyglycol oil into compressor B would give even better results than that indicated for compressor A due to the scale factor, and consequently, the improvement would be even greater than that shown in FIG. 3.

The oils meeting the specified relationships are illustrated by following examples:

It is possible, according to the preferred formula (1) to combine R22 ($\epsilon_r = 6.0$) with SHC oil ($\epsilon_r = 2.1$) but not with Arctic 300 ($\epsilon_r = 2.3$) because $$|\ln 6.0 - \ln 2.1| = 1.05 > 1 \text{ and}$$
$$|\ln 6.0 - \ln 2.3| = 0.96 < 1, \text{ respectively.}$$

Arctic 300 having a $\nu$ value of 32 cSt at 50°C would not meet the requirements of Formula (4) unless the value of $u$ is above the specified limits.

It is possible to combine R12 ($\epsilon_r = 1.8$) with EXD 62/127J) ($\epsilon_r = 5.7$), and propane ($\epsilon_r = 1.3$) with Mobil Glygoyle 30 ($\epsilon_r = 5.0$) because $$|\ln 1.8 - \ln 5.7| = 1.15 > 1 \text{ and}$$

$$|\ln 1.3 - \ln 5.0| = 1.35 > 1, \text{ respectively,}$$

but not with paraffinic mineral oils such as Mobile Arctic 300, because $$|\ln 1.8 - \ln 2.3| = 0.25 < 1; \text{ and}$$

$$|\ln 1.3 - \ln 2.3| = 0.57 < 1;$$

since the formula (4) for $\nu$ cannot be met as Arctic 300 has a viscosity of about 32. This results in a negative exponent requirement for the term $e[(c \cdot p_1)/u]$ which cannot be satisfied.

The application of formula (2) is illustrated in FIGS. 4a and 4b for refrigerants R12 and R22. The pressure curves corresponding to different condensating temperatures are shown as well as the viscosity values of some oils.

From FIGS. *4a* and *4b* it is evident that common mineral oils such as Mobil Gargoyle Artic 300 are excluded.

Referring to FIG. 5, a typical set of operating characteristics and conditions is as follows:

| Example | 1 | 2 | 3 | 4 |
|---|---|---|---|---|
| | Small Refrigeration Compressor | | Large Refr. | Hydrocarbon |
| | Automotive | Stationary | Compressor | Gas Compressor |
| Male Rotor Diameter (mm) | 47 | 64 | 163 | 204 |
| Male Rotor Length/Diameter Ratio | 1.7:1 | 1.3:1 | 1.5 | 1.65 |
| Male Rotor (No. of Lands) | 4 | 4 | 4 | 4 |
| Female Rotor (No. of Grooves) | 6 | 6 | 6 | 6 |
| Driving Rotor | Female | Female | Male | Male |
| Displacement Volume $V_S$ (L/Male Rotor Rev) | 0.084 | 0.161 | 3.16 | 6.81 |
| Motor Speed (rpm) | 1.100 | 3.500 | 3.550 | 2.950 |
| Gear Ratio (Compressor Drive Shaft rpm/Motor rpm) | 1.8:1 | 1:1 | 1:1 | 1:1 |
| Male Rotor Tip Speed (m/s) | 7.3 | 17.6 | 30.3 | 31.5 |
| Gas | R-12 | R-22 | R-22 | Propane |
| Dielectric Constant of Liquified Gas at 50°C | 1.8 | 6.0 | 6.0 | 1.3 |
| Oil Type | Polyglycole | SHC | SHC | Polyglycole |
| Oil Quality | EXD62/127J | EXD62/114J | EXD62/114F | Glygoyle 30 |
| Oil Viscosity at 50°C (cSt) | 278 | 360 | 114 | 148 |
| Dielectric Constant of Oil at 50°C | 5.7 | 2.1 | 2.1 | 5.0 |
| Value of x | 1.15 | 1.05 | 1.05 | 1.35 |
| Oil Flow Injected (l/min) | 2.0 | 3.5 | 60 | 100 |
| Condensing Temperature (°C) | 60 | 50 | 40.6 | 41 |
| Evaporating Temperature (°C) | 0 | +3 | 0 | — |
| Compressor Discharge Pressure (kp/cm² abs) | 15.6 | 19.8 | 15.9 | 14.4 |
| Compressor Inlet Pressure (kp/cm² abs) | 3.15 | 5.6 | 5.0 | 2.4 |
| Compressor Discharge Temperature (°C) | 78 | 82 | 68 | 68 |
| Compressor Inlet Temperature (°C) | 5 | 8 | 5 | −8 |
| Oil Temperature at Separator Outlet (°C) | 77 | 80 | 67 | 66 |
| Temperature of Injected Oil (°C) | 60 | 60 | 45 | 45 |
| Subcooling of Liquid in Condenser (°C) | 1 | 0 | 0 | — |
| Superheat of Refrigerant in Evaporator (°C) | 5.6 | 5 | 5 | — |
| Sucked-in Gas Volume in Compressor (m³/h) | 11.8 | 42.7 | 605 | 1070 |
| Refrigeration Capacity (Kcal/h) | 4.800 | 34.000 | 474.000 | — |
| Compressor Input Torque (NM) | 13.5 | 32.0 | 333 | 700 |
| Compressor Input Power (KW) | 2.8 | 11.7 | 124 | 216 |
| COP | 2.0 | 3.4 | 4.4 | — |

When the gaseous working fluid is compressed and discharged from the compressor with the admixed oil, the temperature of the compressed gaseous medium and oil is high. In a conventional refrigeration or air conditioning cycle working with R12 or R22 it is often in the range of between 70°C and 100°C with conventional condenser temperatures of between about 40°C and 50°C. When the oil is separated from the compressed gas in the oil separator, the temperature of the separated oil is essentially the same as it was when discharged from the compressor, aside from a small drop as a result of heat loss in the line. It has been considered necesssary that the oil when injected into the compressor should be relatively cool, e.g., about 45°C. The reasons for requiring cool oil was that it is known that the viscosity of oil decreases with increased temperature and this would adversely affect efficiency. It was also considered desirable that the oil should be cool to obtain the benefit of cooling during compression to aboid overheating the discharge end of the compressor otherwise require external cooling. The discharge temperatures of such compressors are between about 70°C and 100°C. Since the recycled oil from the oil separator is also used to cool the bearings which support the rotors, cool oil was necessary, e.g., bearing failure on a 205 mm rotor screw compressor occurred with injection of conventional oil at a temperature of 61°C.

An oil cooler was used between the oil separator and the compressor to cool the air to be recycled to the desired low temperature. Since the use of an oil cooler introduces additional equipment and operating costs into the system, it has been desirable to avoid the use of such equipment or to minimize the size thereof. This has been attempted by providing means for cooling the mixture of compressed gaseous working medium and oil before the inlet to the oil separator. Said U.S. Pat. NO. 3,811,291 discloses a means for accomplishing the foregoing by injecting cold liquid refrigerant into the compressor and/or into the line between the compressor discharge and the oil separator.

I have now discovered that in refrigeration systems utilizing halocarbon refrigerants and oil in which the relationship between refrigerant and the oil set forth in formula (1) results in a value of $x$ between 1 and 1.5, and when $v$ meets the requirements of formula (3), the compressor will operate efficiently at higher discharge and oil temperatures, i.e., about 70°C to 130°C. The compressor having a discharge temperature and an oil injection temperature of about 70°C to 110°C will operate at an efficiency substantially equal to (or even higher than) that obtained with injection of cool oil. When the oil and working gaseous medium meet the relationship set forth in this paragraph, some of the gas is dissolved in the oil the amount being dependent on the temperature in the oil separator, resulting in an oil containing dissolved refrigerant which oil has a working viscosity that appears to be substantially constant in the range of 70°C to 110°C. The efficiency is somewhat lower when the temperature increases from 110°C to 130°C.

One of the functions of the oil in oil-injected compressors is to cool the discharge end by lowering the temperature of the gas which is discharged. When the temperature of the injected oil is raised, the discharge temperature of the mixture of gas and oil also is higher. It has been found that as the temperature of the injected oil is increased, the differential between the temperature of the oil which is injected and the discharged oil decreases until an equilibrium condition is reached in which the injected oil is substantially at the same temperature as the discharged oil (disregarding line losses). It has also been found that the compressor will operate efficiently at this equilibrium temperature, i.e., about 70°C to 130°C (and more usually 80°C to 110°C) which would have been considered excessively high before this invention. As noted there is some drop in efficiency at oil injection temperatures above about 110°C. For automobile airconditioning compressors, operating at extremely high condensing temperatures of about 70°C to 80°C, the equilibrium temperature may exceed 130°C. Thus a compressor running at a low speed (2000 rpm) and with a condensing temperature of 75°C will have an equilibrium temperature of 130°C to 150°C but will still provide sufficient cooling capacity.

When the equilibrium temperature at the usual operating conditions is above 110°C the oil from the oil separator may be cooled to a temperature between 105°C and 110°C.

The line heat losses between the compressor discharge and oil separator and between the oil separator and compressor oil inlet may each be between about 1°C and 5°C, and usually about 2°C for each loss, with a total temperature drop of not more than 5°C. With hermetic or semihermetic compressors with internally located oil separators and even with small open type compressors that are not of the hermetic or semi-hermetic type but have an internally located oil separator which latter type could preferably be used for automotive air conditioning compressors the total difference between the compressor discharge temperature and the oil injection temperature may be not more than about 2°C. Compressors having an internally located oil separator position the oil separator and the compressor casing (which encloses the rotors) in a common housing.

In a refrigeration cycle utilizing R22 and SHC oils, for example EXD 62/114J or R12 and polyglycol oils for example EXD 62/127K the system has been found to operate efficiently at a discharge temperature of between about 70°C and 130°C without any cooling of the oil which is obtained from the oil separator and injected into the compressor. The only cooling are the minor line and equipment heat losses. Operation without an oil cooler is for cost saving reasons particularly important in low capacity refrigeration systems such as vehicle air conditioners, residential air conditioners, etc., e.g. refrigeration systems having a compressor rotor diameter of up to about 105 mm. This corresponds to the se of the line 7 bypassing the oil cooler 6 of FIG. 5. Illustrative operating conditions for the system of FIG. 5 in which the oil cooler 6 is eliminated are as follows:

| Example | 5 | 6 | 7 |
|---|---|---|---|
| | Small Refrigeration Compressor | | Large Refr. |
| | Automotive | Stationary | Compressor |
| Male Rotor Diameter (mm) | 47 | 64 | 204 |
| Male Rotor Length/Diameter Ratio | 1.7:1 | 1.3:1 | 1.65:1 |
| Male Rotor (No. of Lands) | 4 | 4 | 4 |
| Female Rotor (No. of Grooves) | 6 | 6 | 6 |
| Driving Rotor | Female | Female | Male |
| Displacement Volume $V_s$ (L/Male Rotor Rev) | 0.084 | 0.161 | 6.81 |
| Motor Speed (rpm) | 1.100 | 3.500 | 2.950 |
| Gear Ratio (Compressor Drive Shaft rpm/Motor rpm) | 1.8:1 | 1:1 | 1:1 |
| Male Rotor Tip Speed | 7.3 | 17.6 | 31.5 |
| Gas | R-12 | R-22 | R-22 |
| Dielectric Constant of Liquified Gas at 50°C | 1.8 | 6.0 | 6.0 |
| Oil Type | Polyglycole | SHC | SHC |
| Oil Quality | EXD62/127K | EXD62/114J | EXD62/114K |
| Oil Viscosity at 50°C (cSt) | 660 | 360 | 114 |
| Dielectric Constant of Oil at 50°C | 6.0 | 2.1 | 2.1 |
| Value of x | 1.20 | 1.05 | 1.05 |

-continued

| Example | 5 | 6 Small Refrigeration Compressor | 7 Large Refr. |
|---|---|---|---|
| Oil Flow Injected (l/min) | 2.0 | 3.5 | 60 |
| Condensing Temperature (°C) | 60 | 40 | 40.1 |
| Evaporating Temperature (°C) | 0 | 0 | 0.8 |
| Compressor Discharge Pressure (kg/cm² abs) | 15.5 | 15.6 | 15.7 |
| Compressor Inlet Pressure (kg/cm² abs) | 3.15 | 5.0 | 5.2 |
| Compressor Discharge Temperature (°C) | 91 | 84 | 86 |
| Compressor Inlet Temperature (°C) | 5 | 5 | 6 |
| Oil Temperature at Separator Outlet (°C) | 90 | 83 | 84 |
| Temperature of Injected Oil (°C) | 87 | 81 | 82 |
| Subcooling of Liquid in Condenser (°C) | 0 | 0 | 0 |
| Superheat of Refrigerant in Evaporator (°C) | 5 | 5 | 5 |
| Sucked-in Gas Volume in Compressor (m³/h) | 12.4 | 43.7 | 1.115 |
| Refrigeration Capacity (Kcal/h) | 5.000 | 34.000 | 900.000 |
| Compressor Input Torque (NM) | 13.5 | 26.5 | 810 |
| Compressor Input Power (KW) | 2.8 | 9.7 | 250 |
| COP | 2.1 | 4.1 | 4.2 |

I claim:

1. Refrigeration apparatus comprising in combination:

an oil injected helical screw compressor for compressing gaseous halocarbon refrigerant, an oil separator connected to said compressor to receive a mixture of compressed gaseous refrigerant and oil containing dissolved refrigerant for separating said compressed gaseous refrigerant from said oil containing dissolved refrigerant, a condenser connected to said oil separator to receive said compressed gaseous refrigerant for liquifying said refrigerant, an evaporator connected to said condenser by a conduit means containing an expansion valve for evaporating said liquified refrigerant to the gaseous state, means for returning said evaporated gaseous refrigerant to the suction end of said compressor, and means for recycling said oil containing dissolved refrigerant to said compressor, said compressor having a male rotor and a female rotor, said male rotor having a diameter of up to about 105 mm and means for being rotated to provide a male rotor tip speed of between about 5 and 30 m/sec, said compressor having a discharge pressure of between about 10 and 30 kp/cm², the dielectric constants of said oil ($\epsilon_{r_{oil}}$) and said liquified refrigerant ($\epsilon_{r_{gas}}$), and the viscosity of the oil, satisfying the following relationships $$\left| \ln \epsilon_{r_{gas}} - \ln \epsilon_{r_{oil}} \right| = x$$

and when $x \geqq 1$ $$v = Y \cdot e^{[(c \cdot P_1)/u]}$$

and when $x < 1$ $$v = \frac{Y}{\sqrt{x}} e^{[(c \cdot p_1)/u]}$$

wherein Y is a value between 25 and 200, ln is the natural logarithm, $\epsilon_r$ is the dielectric constant at 50°C, $v$ is the kinematic viscosity of the pure oil in centistokes at 50°C, $P_1$ is the discharge pressure of the compressor, $u$ is the tip speed of the male rotor, $e$ is the base of the natural system of logarithms, and $c$ is a constant equal to $$1 \frac{\text{cm}^2 \cdot \text{m}}{\text{kp} \cdot \text{sec}}$$

when $P_1$ is measured in kp/cm² and $u$ is measured in m/sec.

2. The apparatus of claim 1 wherein the rotor diameter is between 30 and 105 mm; and wherein Y is between 50 and 100.

3. The apparatus of claim 1 wherein the rotor diameter is between 40 and 105 mm; $x \geqq 1$; and Y is between 50 and 100.

4. The apparatus of claim 1 adapted to be used as a vehicle air-conditioner having a capacity of between 1,000 and 5,000 kcal/h; said condenser is cooled by ambient air; said male rotor has a diameter between 40 and 55 mm and is operated at at least 1,200 rpm; said refrigerant is difluorodichloromethane; and said oil has a dielectric constant between about 4.9 and 8 and a $v$ value between about 270 and 660 cSt.

5. The apparatus of claim 4 wherein said oil is a synthetic polyglycol oil.

6. The apparatus of claim 1 adapted to be used as an air-conditioner having a capacity of between 2.5 and 50 tons of refrigeration, wherein said male rotor has a diameter of between 40 and 105 mm and is operated at between about 2900 and 3600 rpm; said refrigerant is difluoromonochloromethane; and said oil has a dielectric constant between about 1.3 and 2.2 and a $v$ value of between about 80 and 550 cSt.

7. The apparatus of claim 6 wherein said oil is a synthetic hydrocarbon oil having a dielectric constant of about 2.1.

8. The apparatus of claim 1 wherein said means for recycling said oil containing dissolved refrigerant is a direct pipe connection between said oil separator and said compressor and $x$ has a value between 1 and 1.5.

9. The apparatus of claim 4 wherein said means for recycling said oil containing dissolved refrigerant is a direct pipe connection between said oil separator and said compressor and $x$ has a value between 1 and 1.5.

10. The appartus of claim 6 wherein said means for recycling said oil containing dissolved refrigerant is a direct pipe connection between said oil separator and said compressor and $x$ has a value between 1 and 1.5.

11. A method of operating a vehicle air-conditioner comprising:

condensing compressed gaseous difluorodichloromethane refrigerant to a liquid in a condenser cooled by ambient air, evaporating said liquified refrigerant in an evaporator at a temperature between about −5°C and 10°C to form gaseous refrigerant, compressing said gaseous refrigerant in a helical screw compressor having a male rotor with a diameter between 40 and 55 mm operated at between 1,200 and 14,000 rpm while admixing oil containing dissolved refrigerant with said gaseous refrigerant to form a mixture of compressed gaseous refrigerant and oil containing dissolved refrigerant at a discharge pressure of at least 10 kg/cm², separating said compressed gaseous refrigerant from said oil containing dissolved refrigerant and feeding said compressed gaseous refrigerant to said condenser to be liquified, and recycling said oil containing dissolved refrigerant from said oil separator to said compressor, said oil having a dielectric constant at 50°C of between 4.9 and 8 and a kinematic viscosity at 50°C of between about 270 and 660 cSt.

12. The method of claim 11 wherein said oil containing dissolved refrigerant is recycled to said compressor from said oil cooler without any applied cooling.

13. The method of claim 12 wherein said oil containing dissolved refrigerant is recycled to said compressor at a temperature not more than 5°C below the compressor discharge temperature.

14. A method of operating small refrigeration systems comprising:

condensing compressed gaseous halocarbon refrigerant to a liquid in a condenser, evaporating said liquified refrigerant in an evaporator to form gaseous refrigerant, compressing said gaseous refrigerant in a helical screw compressor having a male rotor with a diameter between 30 and 105 mm operated at between about 2,900 and 3,600 rpm while admixing oil containing dissolved refrigerant with said gaseous refrigerant to form a mixture of compressed gaseous refrigerant and oil containing dissolved refrigerant at a discharge pressure of between about 30 and 10 kg/cm², separating said compressed gaseous refrigerant from said oil containing dissolved refrigerant and feeding said compressed gaseous refrigerant to said condenser to be liquified, recycling said oil containing dissolved refrigerant from said oil separator to said compressor, the dielectric constants of said oil and liquified refrigerant, and the viscosity of the oil, satisfying the following relationships $$\left| \ln \epsilon_{r_{gas}} - \ln \epsilon_{r_{oil}} \right| = x$$

and when $x$ 1

$$v = Y \cdot e^{[(c \cdot P_1)/u]}$$

and when $x < 1$ $$v = \frac{Y}{\sqrt{x}} e^{[(c \cdot p_1)/u]}$$

wherein Y is a value between 25 and 200, ln is the natural logarithm, $\epsilon_r$ is the dielectric constant at 50°C, v is the kinematic viscosity of the pure oil in centistokes at 50°C, $P_1$ is the discharge pressure of the compressor, $u$ is the tip speed of the male rotor, e is the base of the natural system of logarithms, and $c$ is a constant equal to $$1 \frac{cm^2 \cdot m}{kp \cdot sec}$$

when $P_1$ is measured in kp/cm² and $u$ is measured in m/sec.

15. The method of claim 14 wherein said refrigerant is difluoromonochloromethane and wherein said oil has a dielectric constant at 50°C of between 1.2 and 2.2 and a viscosity of $v$ of between about 80 and 550 cSt.

16. The method of claim 15 wherein said oil containing dissolved refrigerant is recycled to said compressor at a temperature not more than 5°C below the compressor discharge temperature.

17. The method of claim 14 wherein said oil containing dissolved refrigerant is recycled to said compressor without applied cooling at a temperature not more than 10°C below the compressor discharge temperature.

18. Refrigeration apparatus comprising in combination:

an oil injected helical screw compressor for compressing gaseous halocarbon refrigerant, an oil separator connected to said compressor to receive a mixture of compressed gaseous refrigerant and oil containing dissolved refrigerant for separating said compressed gaseous refrigerant from said oil containing dissolved refrigerant, a condenser connected to said oil separator to receive said compressed gaseous refrigerant for liquifying said refrigerant, an evaporator connected to said condenser by a conduit means containing an expansion valve for evaporating said liquified refrigerant to the gaseous state, means for returning said evaporated gaseous refrigerant to the suction end of said compressor, and means for recycling said oil containing dissolved refrigerant to said compressor, said compressor having a male rotor and a female rotor, said male rotor having a diameter of between about 105 and 300 mm and means for being rotated to provide a male rotor tip speed of between about 15 and 50 m/sec, said compressor having a discharge pressure of between about 10 and 30 kp/cm², the dielectric constants of said oil and liquified refrigerant, and the viscosity of the oil, satisfying the following relationships $$\left| \ln \epsilon_{r_{gas}} - \ln \epsilon_{r_{oil}} \right| = x$$

and when $x \geq 1$ $$v = Y \cdot e^{[(c \cdot P_1)/u]}$$

and when $x < 1$ $$v = \frac{Y}{\sqrt{x}} e^{[(c \cdot p_1)/u]}$$

wherein $Y$ is a value between 30 and 200, ln is the natural logarithm, $\epsilon_r$ is the dielectric constant at 50°C, $v$ is the kinematic viscosity of the pure oil in centistokes at 50°C, $P_1$ is the discharge pressure of the compressor, $u$ is the tip speed of the male rotor, $e$ is the base of the natural system of logarithms, and $c$ is a constant equal to $$1 \quad \frac{cm^2 \cdot m}{kp \cdot sec}$$

when $P_1$ is measured in kp/cm² and $u$ is measured in m/sec.

19. The apparatus of claim 18 wherein Y has a value between 40 and 100, and $u$ has a value between 25 and 40.

20. The apparatus of claim 19 wherein said refrigerant is difluorodichloromethane, and wherein said oil has a dielectric constant between about 4.9 and 8 and a $\nu$ value between about 40 and 330 cSt.

21. The apparatus of claim 19 wherein said refrigerant is difluoromonochloromethane, and wherein said oil has a dielectric constant between about 1.3 and 2.2 and a $\nu$ value between about 80 and 550 cSt.

22. The apparatus of claim 21 wherein said means for recycling said oil containing dissolved refrigerant is a direct pipe connection between said oil separator and said compressor and $x$ has a value between 1 and 1.5.

23. The apparatus of claim 20 wherein said means for recycling said oil containing dissolved refrigerant is a direct pipe connection between said oil separator and said compressor and $x$ has a value between 1 and 1.5.

24. The apparatus of claim 19 wherein said means for recycling said oil containing dissolved refrigerant is a direct pipe connection between said oil separator and said compressor and $x$ has a value between 1 and 1.5.

25. A method of operating refrigeration systems comprising:

condensing compressed gaseous halocarbon refrigerant to a liquid in a condenser cooled by ambient air, evaporating said liquified refrigerant in an evaporator to form gaseous refrigerant, compressing said gaseous refrigerant in a helical screw compressor having a male rotor with a diameter between 105 and 300 mm operated at between about 2,900 and 3,600 rpm while admixing oil containing dissolved refrigerant with said gaseous refrigerant to form a mixture of compressed gaseous refrigerant and oil containing dissolved refrigerant at a discharge pressure of between about 10 and 30 kg/cm², separating said compressed gaseous refrigerant from said oil containing dissolved refrigerant and feeding said compressed gaseous refrigerant to said condenser to be liquified, recycling said oil containing dissolved refrigerant from said oil separator to said compressor, the dielectric constants of said oil and liquified refrigerant, and the viscosity of the oil, satisfying the following relationships $$\left| \ln \epsilon_{r_{kits}} - \ln \epsilon_{r_{oil}} \right| = x$$

and when $x \geqq 1$ $$\nu = Y \cdot e^{[(c \cdot P_1)/u]}$$

and when $x < 1$ $$\nu = \frac{Y}{\sqrt{x}} e^{[(c \cdot p_1)/u]}$$

wherein Y is a value between 25 and 200, $\ln$ is the natural logarithm, $\epsilon_r$ is the dielectric constant at 50°C, $\nu$ is the kinematic viscosity of the pure oil in centistokes at 50°C, $P_1$ is the discharge pressure of the compressor, $u$ is the tip speed of the male rotor, $e$ is the base of the natural system of logarithms, and $c$ is a constant equal to $$1 \quad \frac{cm^2 \cdot m}{kp \cdot sec}$$

when $P_1$ is measured in kp/cm² and $u$ is measured in m/sec.

26. The method of claim 25 wherein said refrigerant is difluorodichloromethane and the oil has a dielectric constant of between 4.9 and 8 and a $\nu$ value between about 270 and 660 cSt.

27. The method of claim 26 wherein said oil is a polyglycol oil.

28. The method of claim 25 wherein said refrigerant is difluoromonochloromethane and wherein said oil has a dielectric constant at 50°C of between 1.2 and 2.2 and a viscosity $\nu$ of between about 80 and 550 cSt.

29. The method of claim 28 wherein said oil has an $\epsilon_r$ of 2.1.

30. The method of claim 29 wherein the compressor discharge temperature is between about 70°C and 110°C and wherein said oil containing dissolved refrigerant being recycled from said oil separator has not been cooled and is at a temperature of not less than 5°C below said compressor discharge temperature when it is recycled to said compressor.

31. The method of claim 25 wherein the compressor discharge temperature is between about 70°C and 110°C and wherein said oil containing dissolved refrigerant being recycled from said oil separator has not been cooled and is at a temperature of not less than 5°C below said compressor discharge temperature when it is recycled to said compressor.

32. The method of claim 25 wherein $x$ has a value between 1 and 1.5 and wherein the compressor discharge temperature is between about 70°C and 110°C and wherein said oil containing dissolved refrigerant being recycled from said oil separator or has not been cooled and is at a temperataure of not less than about 10°C below said compressor discharge temperature.

33. The method of claim 25 wherein said recycled oil is at a temperature not less than about 5°C below said compressor discharge temperature.

34. The method of claim 25 wherein x has a value between 1 and 1.5 and wherein the compressor discharge temperature is between about 70°C and 130°C and wherein said oil containing dissolved refrigerant being recycled from said oil separator or has not been cooled and is at a temperature of not less than about 10°C below said compressor discharge temperature.

35. The method of claim 25 wherein $x$ has a value between 1 and 1.5 and wherein the compressor discharge temperature

36. The method of claim 12 wherein x has a value between 1 and 1.5 and wherein the compressor discharge temperature is between about 70°C and 130°C and wherein said oil containing dissolved refrigerant being recycled from said oil separator has not been cooled and is at a temperature of not more than about 10°C below said compressor discharge temperature.

37. The method of claim 36 wherein said recycled oil is at a temperature not more than about 5°C below said compressor discharge temperature.

38. The method of claim 36 wherein said compressor discharge temperature is between about 80°C and 130°C.

39. The method of claim 17 wherein $x$ has a value between 1 and 1.5 and wherein the compressor discharge temperature is between about 70°C and 130°C and wherein said oil containing dissolved refrigerant being recycled from said oil separator has not been cooled and is at a temperature of not more than about 10°C below said compressor discharge temperature.

40. The apparatus of claim 8 wherein said oil separator is an internally located oil separator.

41. The apparatus of claim 13 wherein said oil separator is an internally located oil separator.

42. The apparatus of claim 14 wherein said oil separator is an internally located oil separator.

43. The apparatus of claim 18 wherein said oil separator is an internally located oil separator.

44. The apparatus of claim 25 wherein said oil separator is an internally located oil separator.

* * * * *

UNITED STATES PATENT AND TRADEMARK OFFICE

CERTIFICATE OF CORRECTION

PATENT NO. : 3,945,216

DATED : March 23, 1976

INVENTOR(S) : HJALMAR SCHIBBYE

It is certified that error appears in the above-identified patent and that said Letters Patent are hereby corrected as shown below:

In each of the following columns and lines, replace the formula with $$--v = Y \cdot e^{[(c \cdot p_1)/u]}--$$

| Column | Line |
|---|---|
| 6 | 8 |
| 13 | 52 |
| 15 | 54 |
| 16 | 55 |
| 17 | 60 |

Column 8, line 61, replace "radio" with --ratio--.

Column 12, the third line from the bottom at the right-hand portion of the Table, replace "EXD62/114K" with --EXD62/114F--.

Column 14, line 39, after "between", insert --about--.

Column 14, line 52, correct the spelling of "apparatus".

Column 15, line 53, replace "x  1" with --$x \geqq 1$--.

Column 18, line 61, after "temperature", insert --is between about 105°C and 110°C by cooling said recycled oil containing dissolved refrigerant between said oil separator and said compressor or by injecting liquified refrigerant into said mixture of gaseous refrigerant and oil containing dissolved refrigerant prior to separation of the gaseous refrigerant from the said mixture.--

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*